US005803891A

United States Patent [19]

Haan et al.

[11] Patent Number: 5,803,891

[45] Date of Patent: Sep. 8, 1998

[54] APPARATUS OF ACCUMULATING SHEETS FOR A BOOKLET

[75] Inventors: Henk Haan, Niagara Falls; R. Joseph Varieur, Sanborn; John A. Sabatowski; John Van de Ven, both of Grand Island, all of N.Y.

[73] Assignee: Moore Business Forms, Inc., Grand Island, N.Y.

[21] Appl. No.: 595,585

[22] Filed: Feb. 1, 1996

[51] Int. Cl.[6] ..... B65H 45/22

[52] U.S. Cl. ..... 493/442; 493/441; 493/454

[58] Field of Search ..... 493/399, 436, 493/438, 441, 442, 443, 446, 447, 402, 454, 423

[56] References Cited

U.S. PATENT DOCUMENTS

| | | | |
|---|---|---|---|
| 276,297 | 4/1883 | Smyth | 493/402 |
| 2,007,209 | 7/1935 | Neidig . | |
| 3,297,315 | 1/1967 | Kunz . | |
| 4,221,373 | 9/1980 | Hans . | |
| 4,310,326 | 1/1982 | Bellanca | 493/441 |
| 4,508,529 | 4/1985 | Feldkamper . | |
| 4,595,187 | 6/1986 | Bober . | |
| 4,721,504 | 1/1988 | Cogswell et al. . | |
| 4,747,817 | 5/1988 | Newsome . | |
| 5,037,365 | 8/1991 | Breton | 493/441 |
| 5,112,291 | 5/1992 | VerMehren . | |

FOREIGN PATENT DOCUMENTS

| | | | |
|---|---|---|---|
| 0170961 | 2/1986 | European Pat. Off. . | |
| 1259923 | 3/1961 | France | 493/443 |
| 2146013 | 3/1973 | Germany . | |
| 3707478 A1 | 10/1987 | Germany . | |
| 457 513 | 8/1968 | Switzerland . | |
| 386372 | 1/1933 | United Kingdom | 493/442 |
| 1504415 | 3/1978 | United Kingdom . | |
| 2006170 | 5/1979 | United Kingdom . | |
| 2270306 | 3/1994 | United Kingdom | 493/399 |

*Primary Examiner*—Jack W. Lavinder
*Attorney, Agent, or Firm*—Nixon & Vanderhye P.C.

[57] ABSTRACT

The folding, and accumulation in configurations simulating a booklet, of flexible sheets (such as paper sheets) is accomplished in a simple, straight-forward, yet effective manner. A movable bar is pivotally mounted at a first end adjacent a cutter from which it receives paper sheets. A plurality of first pulleys having a circumferential periphery with a concave substantially V-shape are mounted by the movable bar and cooperate with a second plurality of pulleys on a stationary V-shaped bar. The second pulleys have convex substantially V-shaped circumferential peripheries with a groove for receipt of a circular cross-section conveyor belt which extends between the sets of pulleys and drives sheets for folding between them. At the discharge end of the folder is a downwardly sloping convex substantially V-shaped accumulator bar which cooperates with a guide (having a concave V-shape) and an automatically movable stop. After a plurality of folded paper sheets in a configuration simulating a booklet are collected, the stop is released and they are transmitted to a binder.

17 Claims, 4 Drawing Sheets

APPARATUS OF ACCUMULATING SHEETS FOR A BOOKLET

BACKGROUND AND SUMMARY OF THE INVENTION

There are a number of different situations where it is desirable to fold paper, or like flexible sheets. Oftentimes the paper sheets, which may be, or form part of, business forms, are desirably formed into booklets. It is desirable to make the booklets utilizing equipment that is as simple, trouble free, and inexpensive—yet effective—as possible. According to the present invention an apparatus is provided that meets these criteria. According to the present invention a simple yet effective folding apparatus is provided, which may be utilized alone or in association with a section for accumulating folded sheets to form booklets. The accumulating section is also simple, having a minimum number of parts, and cooperating fully and being integrated with each other.

According to one aspect of the present invention apparatus for folding flexible sheets is provided comprising the following components: A first pulley having a circumferential periphery having a convex substantially V-shape. A second pulley having a circumferential periphery having a concave substantially V-shape. The pulleys rotatable about spaced parallel axes and positioned with respect to each other so that a portion of the first pulley convex periphery is aligned with and overlaps the second pulley concave periphery. And, a conveyor belt disposed between the first and second pulleys for driving a flexible sheet between the pulleys to effect folding thereof. [The term "pulley" is used in the specification and claims because the devices simulate and at least in some ways act like pulleys. However it is to be understood that this term also encompasses grooved or sectioned or rimmed rollers, cylinders, truncated cones, drums, and the like.]

The folding apparatus also preferably comprises a stationary substantially V-shaped bar mounting the first pulley and providing substantially a continuation of the convex substantially V-shaped portion of the first pulley. The first pulley typically further comprises a groove in the circumferential periphery thereof, and the conveyor belt (which preferably is substantially circular in cross-section) is disposed in the groove.

The second pulley is preferably mounted together with fourth and sixth pulleys in a movable bar, while the first pulley is mounted together with third and fifth pulleys in the stationary substantially V-shaped bar. The second, fourth and sixth pulleys all have substantially the same configuration except that the depth or the length of the concave substantially V-shaped configuration thereof increases from the inlet to the folding apparatus to an outlet. The bar mounting the second, fourth, and sixth pulleys is preferably pivoted for movement about a horizontal axis adjacent its inlet end. The weight of the bar and second, fourth, and sixth pulleys biases those pulleys toward the first, third, and fifth pulleys, and effects folding of the sheets as the sheets are conveyed through the pulleys by the conveyor belt. The folding apparatus may be fed by any suitable paper feeding means, typically a forms cutter. The slitter of the cutter may be modified to act as a scoring device to score the sheets just before they are cut off, so as to facilitate the folding action of the folder.

According to another aspect of the present invention folding apparatus is provided comprising the following components: A movable bar having a plurality of first pulleys mounted thereto for rotation about substantially parallel horizontal axes, the movable bar having a first end and a second end. A substantially horizontal stationary element having a plurality of second pulleys mounted thereto for rotation about substantially parallel horizontal axes, parallel to the axes of the first pulleys, and for cooperating with the first pulleys. A pivot for mounting the movable bar for pivotal movement about a substantially horizontal axis parallel to the axes of the pulleys, adjacent the first end of the bar so that the weight of the bar and the first pulleys biases the first pulleys toward operative association with the second pulleys. And, means for feeding sheets to be folded into operative association with the pulleys adjacent the first end of the bar. The details of the pulleys and the bars mounting them preferably are as described above, with a conveyor belt conveying the sheets between the pulley sets to effect folding.

Also downstream of the folder is an accumulating section, the accumulating section preferably comprising a downwardly sloping (e.g. at about 60°) bar having a convex substantially V-shape. A guide is disposed above the downwardly sloping bar, the guide preferably comprising a concave substantially V-shaped plate having a first end closest to the folding apparatus and a second end most remote from the folding apparatus, the first end being spaced further from the downwardly sloping bar than the second end. An automatically movable stop is provided adjacent the second end of the guide for cooperation with the downwardly sloping bar to either accumulate or release folded sheets in a configuration simulating a booklet. When released the sheets are typically fed to a conventional binder where they are stitched and cut again along the non-stitched sides thereof.

According to another aspect of the present invention apparatus for handling cut sheets to form booklets is provided. The apparatus comprises the following components: A folding assembly for folding the paper sheets, having a feed end and a discharge end. An accumulating section adjacent the discharge end of the folding section, the accumulating section for accumulating folded sheets in a configuration simulating a booklet. And, an automatically operated stop mounted in association with the accumulating section for selectively precluding release of, or releasing, a plurality of folded sheets in a configuration simulating a booklet from the accumulator section. The accumulating section preferably is as described above.

It is the primary object of the present invention to provide a simple yet effective apparatus for folding flexible sheets, and preferably for accumulating the folded sheets in configurations simulating booklets. This and other objects will become clear from an inspection of the detailed description of the invention, and from the appended claims.

DETAILED DESCRIPTION OF THE DRAWINGS

Figure 1:
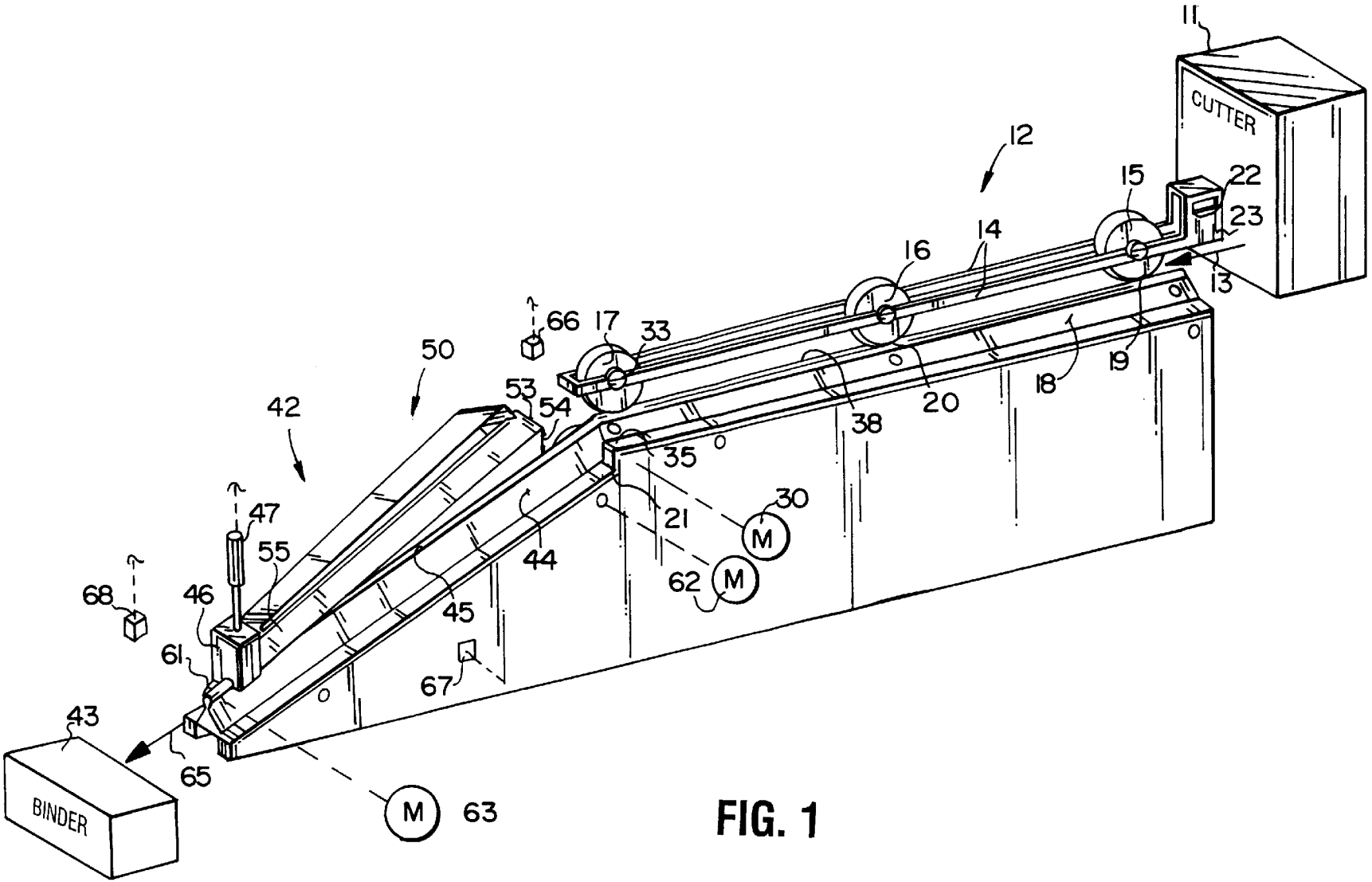
FIG. 1 is a top perspective schematic view of exemplary folding and accumulating apparatus according to the present invention in cooperation with a cutter and binder.
Figure 8:
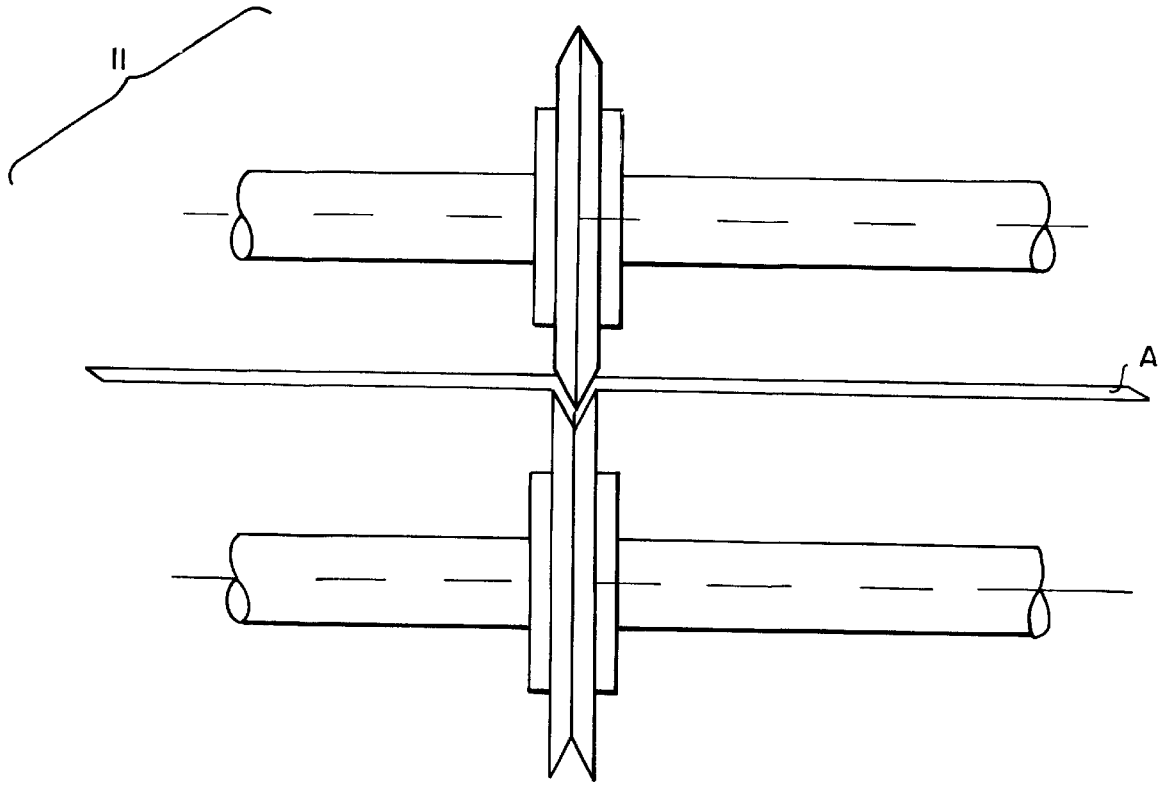
FIG. 8 is a schematic end view of the scoring device in the conventional cutter of an exemplary apparatus according to the invention.

FIG. 1 schematically illustrates apparatus for cutting, folding, accumulating into configurations simulating booklets, and binding of the booklets. The cutter is shown schematically by reference numeral 11 in FIG. 1, and may be of any conventional type for cutting forms or other paper sheets. The cutter 11 preferably utilizes a modified slitter, so that the slitter acts as a scoring device that scores the paper sheets before they are cut off, and which thereby facilitates folding in the folding section shown schematically at 12 in FIG. 1. A conventional form that the "scoring device" of cutter 11 may take is illustrated in FIG. 8 in association with a paper sheet A.

While it is preferred that the folding section 12 be fed by a cutter 11, with the sheets traveling in the direction of arrow 13 in FIG. 1, other suitable feed mechanisms may be provided, such as conventional conveyors of all types, or punching, bursting, or like conventional forms and paper sheet handling equipment.

The novel folding section 12 according to the present invention has cooperating pulleys for effecting folding action. In the actual preferred embodiment illustrated there is a movable bar 14 which mounts a first set of a plurality of pulleys 15,16,17, and there is a substantially stationary bar 18 which mounts a cooperating second set of pulleys shown by reference numerals 19, 20, and 21 in FIG. 1. In the preferred embodiment illustrated, the movable bar 14 is pivotally mounted—as by pivot pin 22—adjacent the first end 23 thereof which is closest to the cutter 11 at the infeed end of the folder 12, and most remote from the second end 24 of the bar 14.

Figure 3:
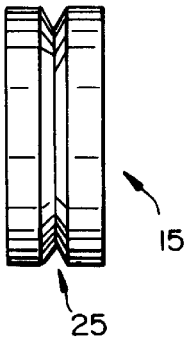
FIGS. 3 through 5 are side elevational views of the three different concave pulleys of the folding section of the apparatus of FIG. 1, the pulley of FIG. 3 being closest the cutter, the pulley of FIG. 5 most remote from the cutter, and the pulley of FIG. 4 between the pulleys of FIGS. 3 and 5.
Figure 4:
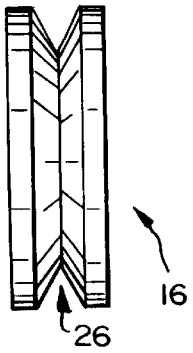
Figure 5:
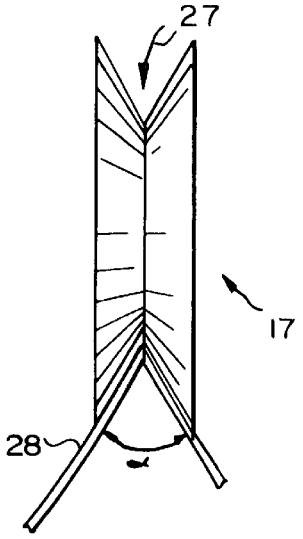

The pulleys 15 through 17 are illustrated in elevational view in FIGS. 3 through 5, respectively. Each of the pulleys 15 through 17 (preferably of metal) includes a concave substantially V-shaped circumferential periphery, illustrated at 25 in FIG. 3, 26 in FIG. 4, and 27 in FIG. 5. FIGS. 3 through 5 are to the same scale, illustrating that the length of the concave V-shaped peripheral portions 25–27 of the pulleys 15 through 17 increase in size from the first end 23 of the bar 14 to the second end 24 thereof. All of the pulleys 15 through 17 are preferably rotatable about substantially horizontal axes, parallel to the pivot axis defined by pivot pin 22. The configuration of the pulleys 15 through 17 as illustrated in FIGS. 1 and 3 through 5 means that the paper sheet (form) is folded downwardly in increments, only slightly downwardly by the pulley 15, with a maximum fold by the third pulley 17, the pulley 17 typically folding a paper sheet—illustrated schematically at 28 in FIG. 5—the maximum amount of about 60° (that is the angle $\alpha$ in FIG. 5 is about 60°).

The pulleys 19 through 21 (also preferably of metal) are also rotatable about a horizontal axes parallel to those of the pulleys 15–17, and cooperating with the pulleys 15 through 17. The weight of the bar 14 and the pulleys 15–17 provides cooperation between the first and second sets of pulleys to properly engage the paper sheets 28 to fold them as they are being fed in the direction 13. Because only the weight of the bar 14 and the pulleys 15 through 17 biases them into place, there is the ability of the paper to slip between the upper pulleys 15–17 and the lower pulleys 19–21. This is highly desirable because the paper momentarily stops when it is being cut off with a guillotine knife (or like cutting element) of the cutter 11. It is not desirable to stop the motor 30 which drives the paper in the direction 13 through the folder section 12. When the paper sheet 28 is then cut, the sheet 28 is then again engaged by the pulleys and driven in the direction 13.

Figure 2:
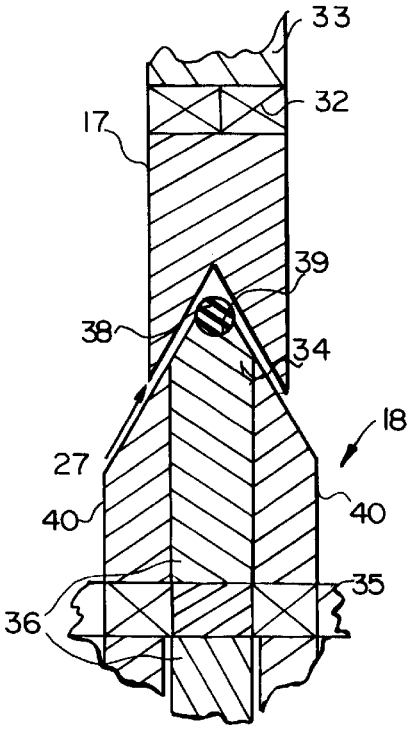
FIG. 2 is a detail longitudinal cross-sectional view of cooperating folding pulleys of the folding section of the apparatus of FIG. 1.

FIG. 2 illustrates in detail the cooperation between the pulleys 17,21, the cooperation of the pulleys 16, 20, and 15,19 being similar (except that the concave V-shaped portions of the pulleys 15,16 are not as deep).

In FIG. 2 the pulley 17 is shown rotatable about a horizontal axis because it is mounted by the bearing 32 and the shaft 33, the shaft 33 being mounted in the bar 14. The pulley 21 has a circumferential periphery 34 that is convex and substantially V-shaped, the pulley 21 rotatable about a horizontal axis defined by the shaft 35, the shaft 35 mounted by bearings 36. The convex V-shaped circumferential peripheral portion 34 at least partially overlaps, and is overlapped by, the concave substantially V-shaped circumferential peripheral portion 27 of the pulley 17, as illustrated in FIG. 2. Thus, the V-shaped circumferential peripheral portion 34 lies within the peripheral confines of pulley 17, i.e., V-shaped portion 34 lies at least partially within the concave V-shaped portion 27 of pulley 17 and radially inwardly of its outer periphery. Similarly, portions of pulleys 16 and 20 preferably lie within the peripheral confines of pulleys 15 and 19, respectively.

In order to actually drive the paper 28 between the cooperating sets of pulleys (e.g. 17, 21) a conveyor belt is provided. The conveyor belt is shown by reference numeral 38 in FIGS. 1 and 2. As seen in FIG. 2 the conveyor belt 38 preferably is substantially circular in cross-section and travels in a groove 39 formed in the apex of the circumferential periphery 34 of the pulley 21 (and each of the pulleys 19, 20 too). The motor 30—preferably a variable speed electric motor—rotates the pulley 21 by driving the shaft 35. Preferably all of the pulleys 15 through 17 are idler pulleys, as are the pulleys 19, 20.

The stationary bar 18 also preferably has a convex substantially V-shape which is a continuation of that the circumferential peripheral portion 34 of the pulleys 19 through 21. For example see the V-shaped surfaces 40 of the bar 18 in FIG. 2.

The paper sheets/forms 28 are discharged from the second end 24 of the folding section 12 and pass into the accumulating section, shown generally by reference numeral 42 in FIG. 1. In the accumulating section 42 a plurality of individual folded sheets from the folding section 12 automatically stack upon each other providing a configuration simulating a booklet, and once the appropriate number of sheets have been collected they are discharged from the accumulating section 42 to a downstream apparatus 43, such as a conventional binder (using staples, stitching, and/or adhesive to hold the sheets together).

The accumulating section 42 preferably includes a downwardly sloping bar 44 as one of the main components thereof. The top surface 45 of the bar 44 preferably makes an angle of about 60° with respect to the horizontal line defined by the direction 13 between the sets of pulleys 15 through 17 and 19 through 21. As seen in FIG. 1, the downwardly sloping bar 44 preferably has a convex substantially V-shaped configuration, which corresponds closely to that of the bar 18 and the pulley 21, and has a length greater than the dimension (in direction 13) of a paper sheet 28 which will accumulate thereon.

The accumulating section 42 also includes an automatically movable paper/forms stop 46. The stop 46—when in its downward position as illustrated in FIG. 1—causes sheets 28 to accumulate on the bar 44. When the stop 46 is pulled upwardly (for example by reciprocation of the piston rod 47) the sheets accumulated on the bar 44 are discharged therefrom. While any suitable linear actuator may be utilized to reciprocate the piston rod 47, a pneumatic or hydraulic cylinders, such as illustrated schematically at 48 in FIG. 7, is preferred.

Figure 6:
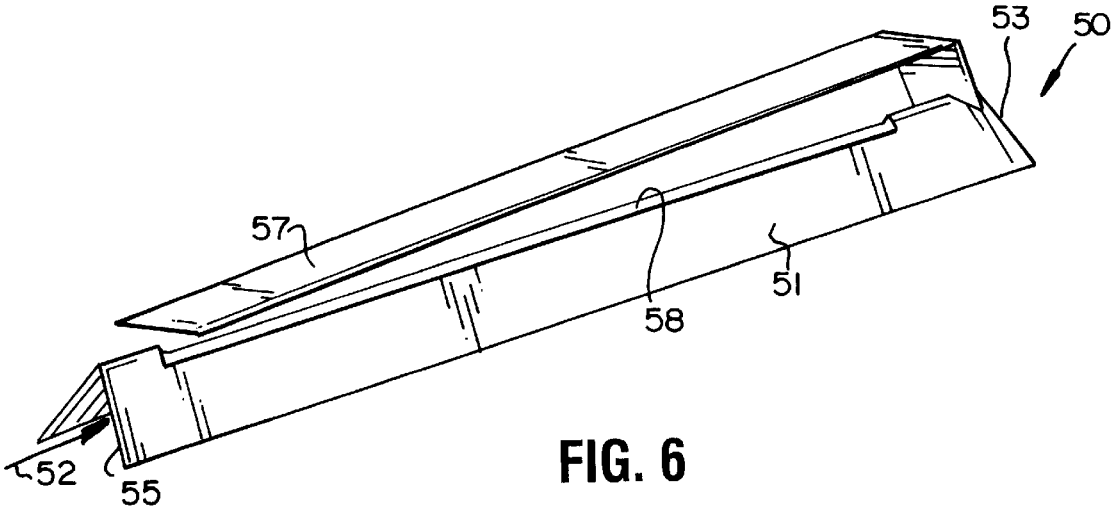
FIG. 6 is a top perspective detail view of the guide associated with the accumulating section of the apparatus of FIG. 1.

The accumulating section 42 also includes a guide, shown generally by reference numeral 50 in FIGS. 1 and 6. The guide 50 preferably comprises a metal plate 51 which has a concave substantially V-shaped interior configuration—shown generally at 52 in FIG. 6. Note that the guide 50 is positioned—as illustrated in FIG. 1—so that the leading end 53 thereof (closest to the folding section 12) is spaced a distance 54 from the bar 44 which is greater than the spacing of the second end 55 of the guide 50 from the bar 44. As seen most clearly in FIG. 6, the guide 50 also preferably includes a flat plate 57 on the top thereof that prevents folded sheets from getting trapped in the slot 58 formed at the apex of the substantially V-shaped concave interior of the plate 51.

The accumulator section 42 also includes a first driven roller 60, and a second driven roller 61, driven by the electric motor 62, 63 respectively. The roller 60 assists in feeding the cut sheets from the folding section 12 into the accumulator section 42 and operates during that infeed operation. The roller 61 is not powered during the infeed operation, but once the stop 46 is lifted up to release the accumulated sheets it is actuated by the motor 63 to discharge sheets in the configuration simulating a booklet in the direction of the arrow 65 to the binder 43 or the like.

Figure 7:
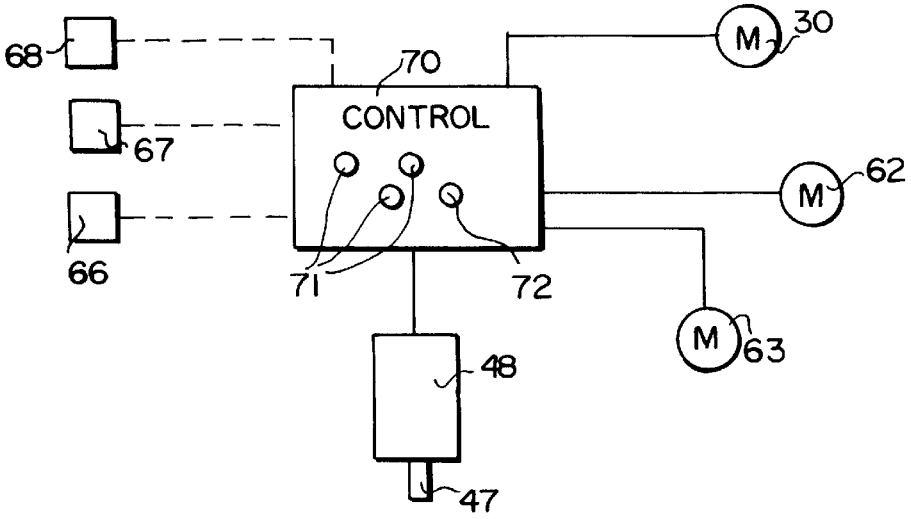
FIG. 7 is a control schematic illustrating the controls for the apparatus of FIG. 1.

A plurality of sensors are also preferably associated with the accumulator section 42, the sensors being illustrated schematically by reference numerals 66, 67, and 68 in FIGS. 1 and 7. The sensor 66 which may be an optical sensor of conventional configuration) is a count sensor and senses the lead edge of paper sheets 28 as they are delivered into the accumulator 42 from the folder 12. A signal from the count sensor 66 is provided to the computer control 70 (see FIG. 7) having a counter therein, so that the number of sheets being fed to the accumulator 42 are counted. Also the sensor 66 acts to sense the presence of jam in the infeed of the section 42 (if a sheet is present in the field of view of the sensor 66 for too long a period of time).

The sensor 67, also preferably an optical sensor, is a hopper sensor. It senses sheets accumulated on the accumulator 42 (e.g. under the guide 50 and adjacent the stop 46) and allows operation of the cylinder 48 and motor 63 once the number of desired sheets has been counted, if a sheet is sensed by the sensor 67. Sensor 67 also senses a jam in the accumulated sheets if a sheet is still sensed thereby after a period of time after the stop 46 is lifted.

The third sensor 68, also preferably an optical sensor, is a flight sensor, and it senses the flight or period that ejection can take place from the accumulator 42 to the binder 43.

The computer control 70 cooperates with the sensors 66 to 68 to control the motors 62, 63 and the cylinder 48. The control 70 also controls the motor 30. Various manual operator controls—shown schematically at 71 in FIG. 7—also may be provided to manually control all of the components if desired. Also alarm indicator 72 or the like may be provided which provide an audible, visual, or both, signal in response to sensing of a jam (e.g. by sensors 66, 67).

The accumulator 42 is preferably constructed to accept 11 inch length by 17 inch width sheets which are center scored (folded by the folder 12) and it can accumulate sheets in any number ranging from about 1–30. While it is preferred that ejection of the sheets be controlled by a counter cooperating with the sensor 66, alternatively either the sensor 66 or the sensor 67 can sense a bar code or other indicia (or a magnetic strip if the sensors are magnetic) on the last sheet of the booklet.

It will thus be seen that according to the present invention a simple, inexpensive, yet effective apparatus has been provided. While the apparatus has presently been illustrated and described in what is presently conceived to be the most practical and preferred embodiment thereof it will be apparent to those of ordinary skill in the art that many modifications may be made thereof within the scope of the invention. For example instead of three sets of pulleys 15 through 17, 19 through 21, under some circumstances only one or two sets of pulleys may be provided, or more than three sets. Also pivoting of various elements, and mounting of the elements, can be accomplished by any suitable conventional structure, and any suitable drive mechanisms may also be utilized instead of just those illustrated. The claims are to be interpreted so as to encompass all equivalent structures and devices.

What is claimed is:

1. Apparatus for folding flexible sheets comprising:

a first pulley having a circumferential periphery having a convex substantially V-shape;

a second pulley having a circumferential periphery having a concave substantially V-shape;

said pulleys rotatable about spaced parallel axes and positioned with respect to each other so that a portion of said first pulley convex periphery is aligned with and overlaps said second pulley concave periphery, said first convex pulley being received within peripheral confines of said second concave pulley; and a conveyor belt disposed between said first and second pulleys for driving a flexible sheet between said pulleys to effect folding thereof.

2. Apparatus as recited in claim 1 further comprising a substantially V-shaped bar mounting said first pulley and providing substantially a continuation of said convex substantially V-shaped portion of said pulley along an apex therof.

3. Apparatus as recited in claim 1 wherein said first pulley further comprises a groove in said circumferential periphery thereof, and wherein said conveyor belt is disposed in said groove.

4. Apparatus as recited in claim 3 further comprising a third pulley having a circumferential periphery having a convex substantially V-shape; and a fourth pulley having a circumferential periphery having a concave substantially V-shape, said third convex pulley being received within peripheral confines of said fourth concave pulley; said conveyor belt also disposed between said third and fourth pulleys for driving a flexible sheet between said pulleys to effect folding thereof, and said third pulley having a groove in which said conveyor belt is disposed, said conveyor belt lying within peripheral confines of said second and fourth concave pulleys.

5. Apparatus as recited in claim 4 further comprising a movable bar mounting said second and fourth pulleys so that the axes of rotation thereof are spaced a predetermined position from each other and so that said second and fourth pulleys are movable together.

6. Apparatus as recited in claim 5 wherein said movable bar has first and second ends, and wherein said bar is pivotally mounted adjacent said first end thereof for movement about a substantially horizontal pivot axis, and wherein said first through fourth pulleys are each rotatable about a substantially horizontal axis substantially parallel to said pivot axis.

7. Apparatus as recited in claim 6 further comprising a fifth pulley having a circumferential periphery having a convex substantially V-shape, and a sixth pulley having a circumferential periphery having a concave substantially V-shape, said conveyor belt disposed between said fifth and sixth pulleys for driving a flexible sheet between said pulleys to effect folding thereof; said sixth pulley mounted on said bar so that the axis of rotation thereof is spaced a fixed distance from said fourth pulley and so that it is pivotal with said bar about said bar axis; and said fifth pulley has a groove in which said conveyor belt is disposed.

8. Apparatus as recited in claim 7 wherein said second pulley is closest to said movable bar axis and said sixth pulley is most remote from said movable bar axis, said fourth pulley between said second and sixth pulleys; and wherein said sixth pulley has a longer, concave substantially V-shape than said fourth pulley, and said fourth pulley has a longer concave substantially V-shape than said second pulley.

9. Apparatus as recited in claim 7 wherein said conveyor belt has a substantially circular cross-section.

10. Apparatus as recited in claim 3 wherein said conveyor belt has a substantially circular cross-section.

11. Apparatus for folding flexible sheets comprising:

a movable bar having a plurality of first pulleys mounted thereto for rotation about substantially parallel horizontal axes, said movable bar having a first end and a second end;

a substantially horizontal stationary element having a plurality of second pulleys mounted thereto for rotation about substantially parallel horizontal axes, parallel to the axes of said first pulleys, and for cooperating with said first pulleys;

a pivot for mounting said movable bar for free pivotal movement about a substantially horizontal axis parallel to the axes of said pulleys, adjacent said first end of said bar so that the weight of said bar and said first pulleys biases said first pulleys toward operative association with said second pulleys, said second end of said movable bar being free of attachment to said apparatus; and means for feeding sheets to be folded into operative association with said pulleys adjacent said first end of said bar whereby sheets fed between said first and second pulleys are folded by the operative association of said first and second pulleys.

12. Apparatus as recited in claim 11 wherein said stationary element comprises a substantially V-shaped convex bar and wherein said second pulleys each have a circumferential periphery that has a convex substantially V-shape; and wherein said first plurality of pulleys each have a circumferential periphery having a concave substantially V-shape cooperating with said convex V-shapes of said second pulleys, each cooperating first and second pulley being disposed such that said convex second pulley lies within peripheral confines of said first concave pulley.

13. Apparatus as recited in claim 12 further comprising a conveyor belt extending between said first and second pulleys and for driving paper sheets or the like from said first end of said bar toward said second end thereof.

14. Apparatus as recited in claim 11 wherein said means for feeding paper sheets between said pulleys adjacent said first end of said bar comprises a cutting mechanism.

15. Apparatus as recited in claim 11 further comprising folded sheet accumulating means provided adjacent said second end of said bar for accumulating a plurality of folded sheets simulating a booklet configuration.

16. Apparatus as recited in claim 15 wherein said accumulating means comprises a downwardly sloping convex substantially V-shaped bar; said downwardly sloping bar having a first end adjacent said pulleys and a second end remote from said pulleys; an automatically powered stop adjacent said second end of said downwardly sloping bar; and a guide mounted above said downwardly sloping bar.

17. Apparatus as recited in claim 16 wherein said guide comprises a concave substantially V-shaped plate having a first end closest to said pulley and a second end closest to said stop, said first end spaced from said downwardly sloping bar a greater distance than said second end is spaced from said downwardly sloping bar.

* * * * *